US009339670B1

(12) United States Patent
Burnham et al.

(10) Patent No.: US 9,339,670 B1
(45) Date of Patent: May 17, 2016

(54) VERTICAL POLE SPRAYING SYSTEM

(71) Applicants: Robert J Burnham, Loomis, CA (US); Jesse Paul Van Horn, Loomis, CA (US)

(72) Inventors: Robert J Burnham, Loomis, CA (US); Jesse Paul Van Horn, Loomis, CA (US)

( * ) Notice: Subject to any disclaimer, the term of this patent is extended or adjusted under 35 U.S.C. 154(b) by 0 days.

(21) Appl. No.: 14/215,291

(22) Filed: Mar. 17, 2014

Related U.S. Application Data

(60) Provisional application No. 61/789,435, filed on Mar. 15, 2013.

(51) Int. Cl.

| | |
|---|---|
| ***B05B 13/02*** | (2006.01) |
| ***B05B 13/04*** | (2006.01) |
| ***A62C 3/00*** | (2006.01) |
| ***B05B 15/06*** | (2006.01) |
| ***B05B 13/00*** | (2006.01) |
| *B08B 9/023* | (2006.01) |

(52) U.S. Cl.
CPC ..... *A62C 3/00* (2013.01); *B05B 13/005* (2013.01); *B05B 13/0207* (2013.01); *B05B 13/0214* (2013.01); *B05B 13/0436* (2013.01); *B05B 15/061* (2013.01); *B08B 9/023* (2013.01); *Y10S 118/11* (2013.01)

(58) Field of Classification Search
USPC ..... 118/DIG. 11
See application file for complete search history.

(56) References Cited

U.S. PATENT DOCUMENTS

| | | | | |
|---|---|---|---|---|
| 2,357,144 | A * | 8/1944 | Stair | 118/307 |
| 2,470,994 | A * | 5/1949 | Kremko et al. | 118/307 |
| 2,535,451 | A * | 12/1950 | Phillips | 118/305 |
| 2,557,696 | A * | 6/1951 | Schaefer | 118/681 |
| 2,851,005 | A * | 9/1958 | Pledger | 118/307 |
| 3,021,293 | A * | 2/1962 | Simon | 524/387 |
| 3,581,441 | A * | 6/1971 | Hulbert, Jr. | 451/2 |
| 3,942,565 | A * | 3/1976 | Ratelle et al. | 144/340 |
| 4,077,356 | A | 3/1978 | Andrews | |
| 4,895,205 | A * | 1/1990 | Thompson et al. | 166/90.1 |
| 5,069,234 | A * | 12/1991 | Nielsen | 134/113 |
| 5,180,018 | A * | 1/1993 | Taylor | 169/47 |
| 5,746,031 | A | 5/1998 | Burns | |
| 6,626,376 | B1 * | 9/2003 | Rose | 118/DIG. 11 |
| 7,622,001 | B2 | 11/2009 | Inada et al. | |
| 8,151,898 | B2 | 4/2012 | Merchant | |
| 2010/0226724 | A1 * | 9/2010 | Doleshal | 405/211 |

* cited by examiner

*Primary Examiner* — Binu Thomas
(74) *Attorney, Agent, or Firm* — James L Farmer

(57) ABSTRACT

Methods and apparatus are provided for a system for applying a fluid chemical treatment to a vertical column. In one embodiment the system includes a frame configured to generally surround the column, with a substantial gap between an inner surface of the frame and an outer surface of the column. The system may further include a centering guide on the inner surface of the frame, and an array of fluid spray nozzles connected to a pressurized fluid chemical source, and arranged to apply a uniform spray coating to the column. A mobility system vertically translates the frame along the column in a level orientation while fluid chemical is being applied.

17 Claims, 18 Drawing Sheets

VERTICAL POLE SPRAYING SYSTEM

Provisional Patent Application Ser. No. 61/789,435, to which the present application claims priority, is hereby incorporated by reference.

TECHNICAL FIELD

The technical field of the present invention generally relates to application of fluid chemical treatments to a substrate, including for example, application of fire retardant chemical treatment to a porous or flammable structure such as a wood utility pole.

DESCRIPTION OF THE EMBODIMENTS

Figure 1:
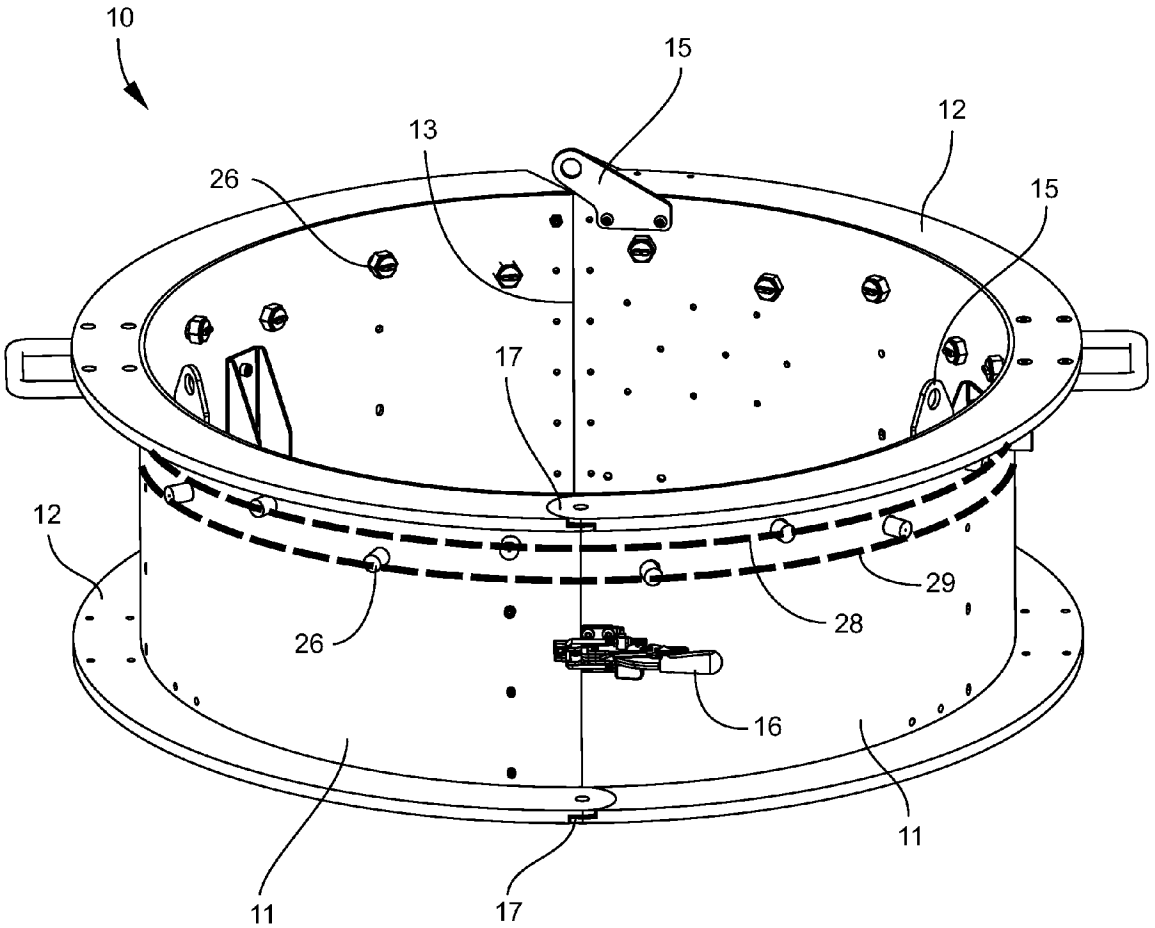
FIG. 1 is top perspective view of an exemplary spray frame in accordance with the pole spraying system of the present disclosure.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

The vertical pole spraying system is comprised generally of a spray frame or housing configured to surround and spray liquid chemical onto a vertical pole, a mobility system adapted to move the frame along the vertical axis of a pole at a set and precise speed while maintaining a uniform annular gap between the inside of the frame and the outside surface of the pole, and a pressurized liquid chemical source connectable to the spray frame. The system may be utilized for example to uniformly spray coat fire retardant chemical onto a lower section of a wood utility pole of the type typically used for power transmission/distribution and communication.

Spray Frame

Figure 2A:
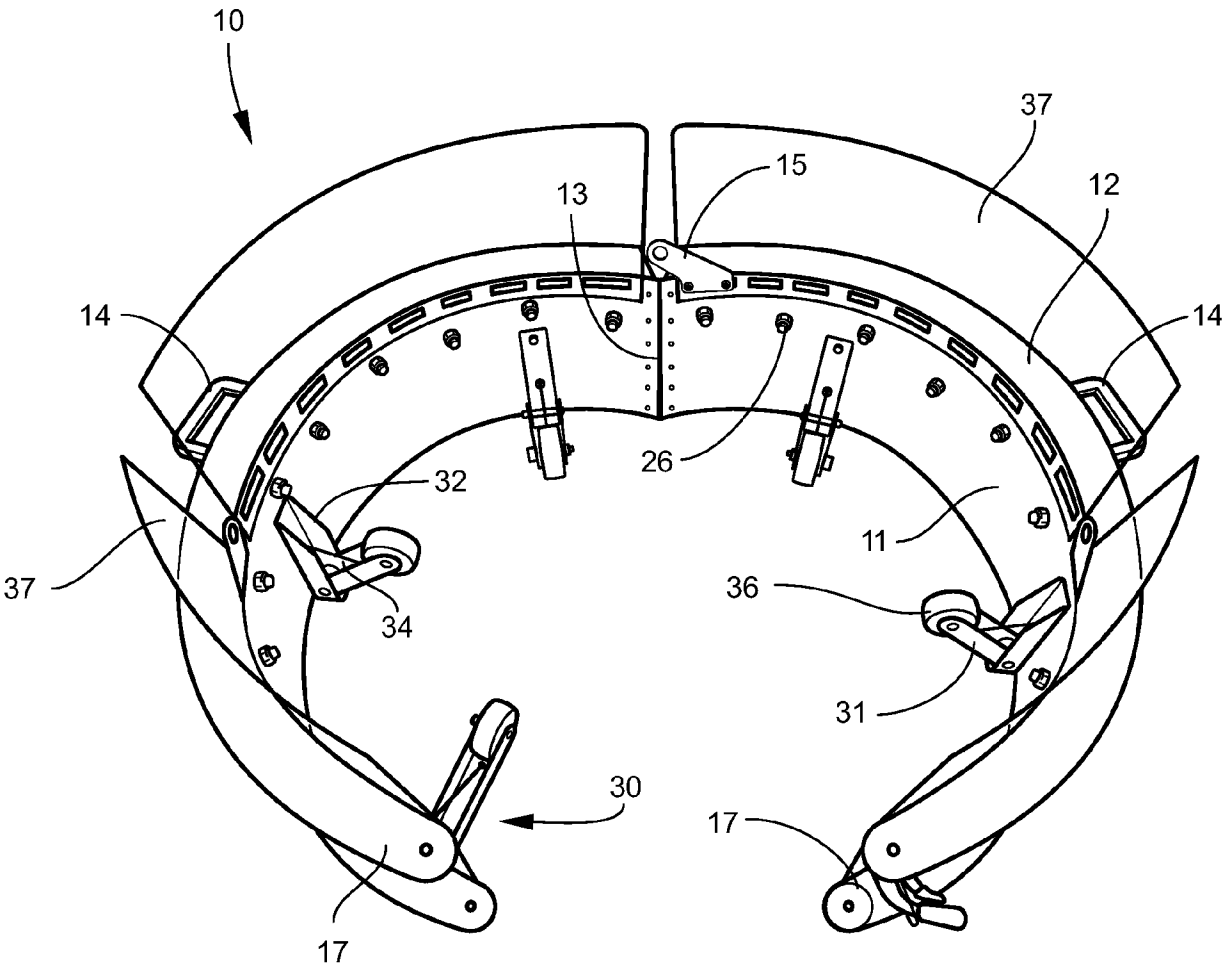
FIGS. 2A and 2B are perspective views of a hinged clamshell style spray frame.
Figure 2B:
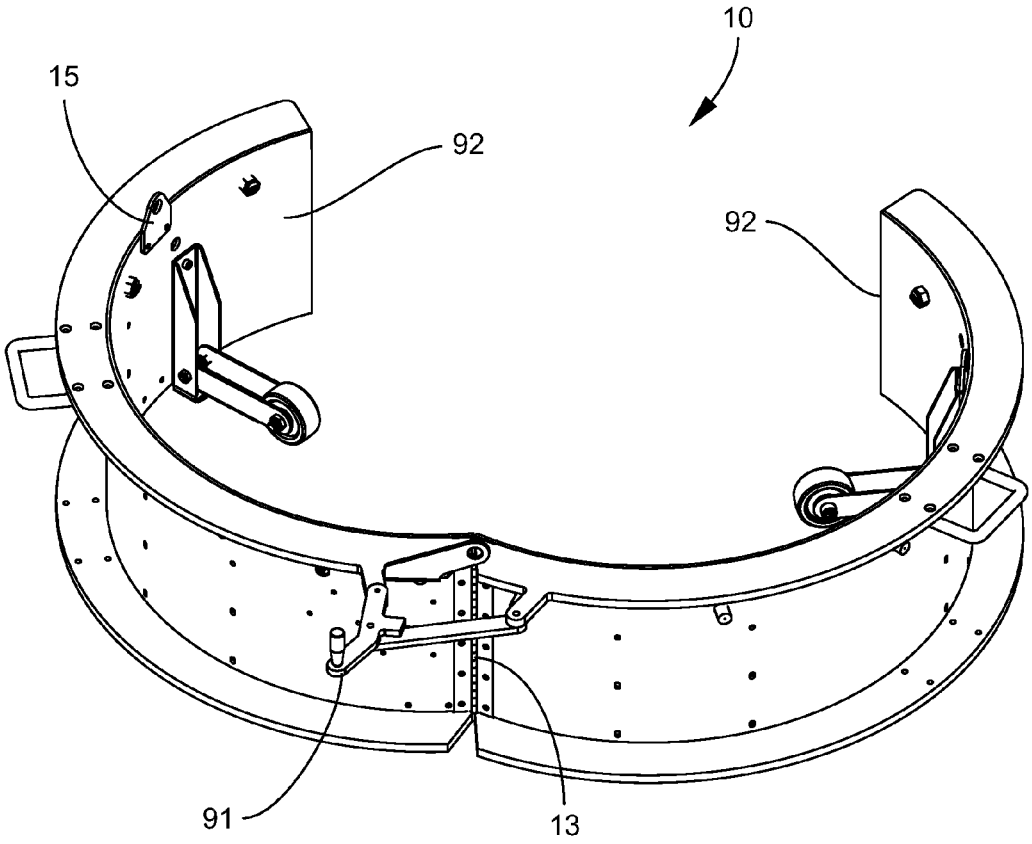
Figure 3:
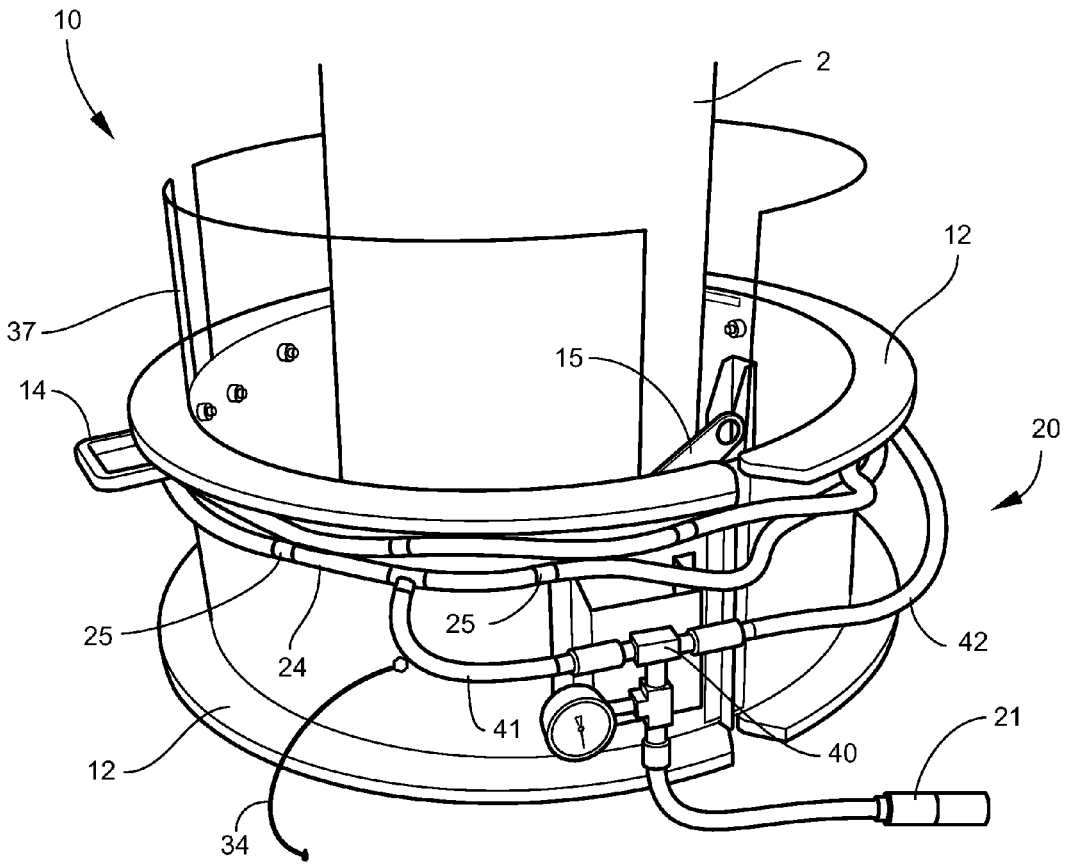
FIG. 3 is a side perspective view of the clamshell style spray frame of FIG. 2 in position around a vertical pole for initiating a spraying operation, showing the manifold fluid distribution system, and anti-drift shield.

Referring now to the drawing Figures, an exemplary spray frame 10 in accordance with the present disclosure comprises a circular frame body 11 capped by upper and lower ring flanges 12, configured in two semi-circular halves. The two frame halves may be connected along one edge by a frame hinge 13 in a clamshell arrangement as best seen in FIGS. 2A and 2B. The frame may thus be installed around a vertical pole, such as the wood utility pole 2 shown in FIG. 3, by positioning the open frame halves around the pole and bringing the two halves together. Once in position, the free ends of the frame halves may be secured together such that the two halves form essentially a single rigid structure. For example, the frame halves may be connected using a latch 16 to lock together the ends of frame body 11, and lap joints 17 to link and stabilize the ends of the ring flanges 12.

FIG. 2B shows an embodiment of the clamshell type spray frame with a hand crank 91 operably linked to both frame halves. Hand crank 91 may be effectively used by one person to open and close the frame halves without assistance for installation or removal at the pole. The hand crank may further incorporate a detent that maintains the frame halves in the closed position for spraying, allowing for the free ends 92 of the frame halves to be spaced apart somewhat when spraying instead of necessarily latched together as in FIG. 1.

Manifolds

Figure 4:
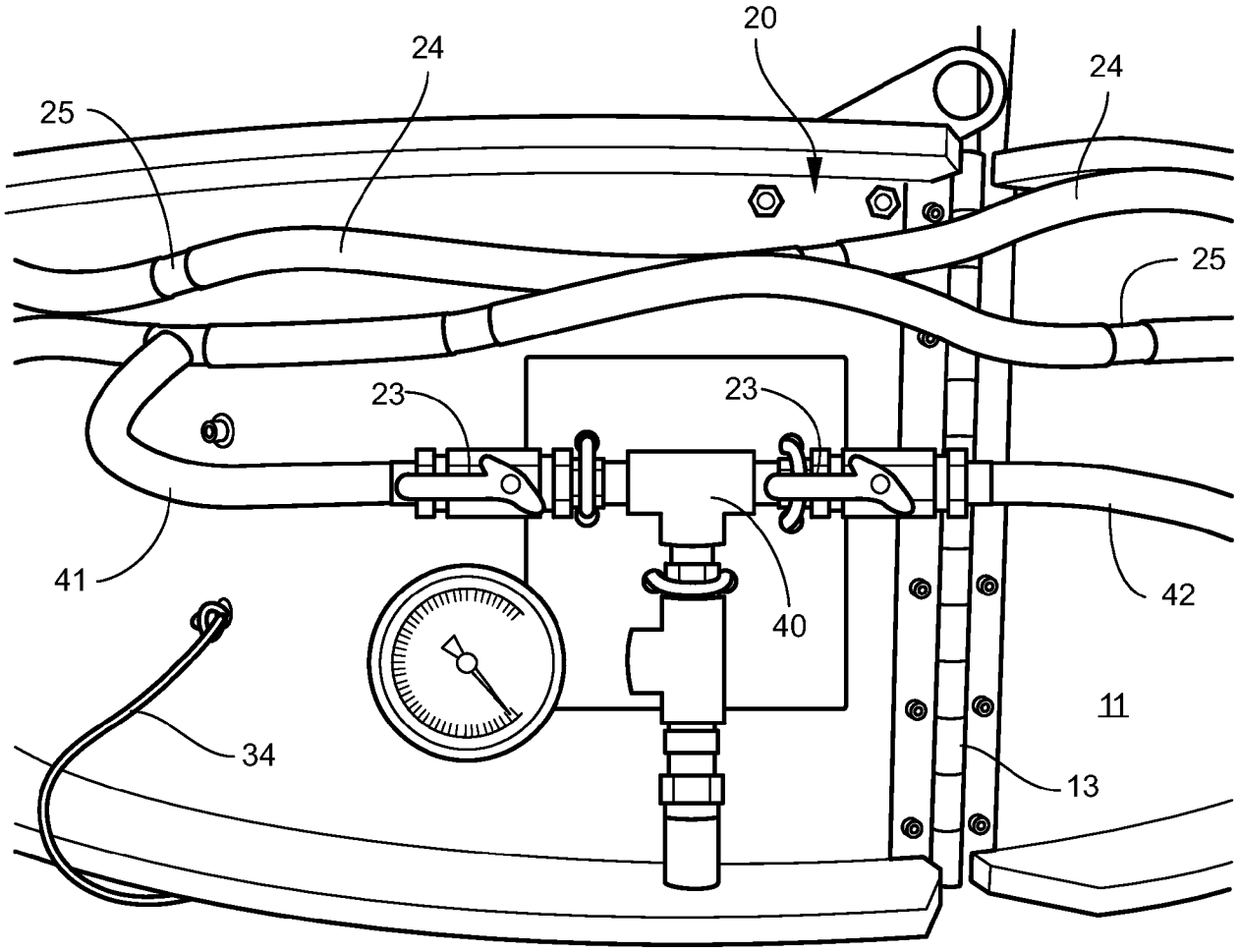
FIG. 4 is a close-up side view of the hinged side of the clamshell spray frame showing the main splitter, and manifold system of distribution hoses and T-connectors.

The spray frame is adapted to dispense a liquid chemical in a uniform spray from the inside of the frame. In one embodiment a plurality of spray nozzles 26 are evenly distributed around the inside surface of the frame body 11 (see FIGS. 1 and 2), and oriented to spray directly at a vertical pole centered inside the spray frame. The pressurized liquid chemical is fed simultaneously and evenly to the nozzles 26 through a manifold 20. The manifold may be separate components attached to the spray frame, an integral portion of the spray frame, or essentially comprise the spray frame itself. Referring to FIG. 4, the manifold 20 may be a separate construction comprising standard threaded T-connectors 25 inserted through holes in the spray frame body 11, linked together on the outside of the frame body via distribution hoses 24. The spray nozzles 26 are threaded onto the protruding ends of the T-connectors on the inside of the frame body 11, and are thus easily accessible for replacement or adjustment as may be needed.

The spray frame may be configured with a single manifold supplying all of the spray nozzles, or more than one manifold, each one supplying a portion, or set of spray nozzles. For example, the spray frame may be configured with a first manifold 41 connected to a first ring or set of spray nozzles, and a second manifold 42 connected to a second ring or set of spray nozzles positioned above the first ring of nozzles in the depicted embodiment. The manifolds merge at a splitter 40 with a chemical supply hose connection 21 (see FIG. 3) connectable to a single chemical supply hose 63 (see FIG. 6). Pressurized liquid chemical is evenly divided and distributed through the splitter 40 to each of the one or more manifolds. Each manifold may be further equipped with a shut-off valve 23 operable to prevent pressurized fluid from entering the manifold. The shut-off valves may thus be used for example to turn off one set of nozzles while allowing a different set of nozzles to dispense chemical.

Nozzles

Figure 5:
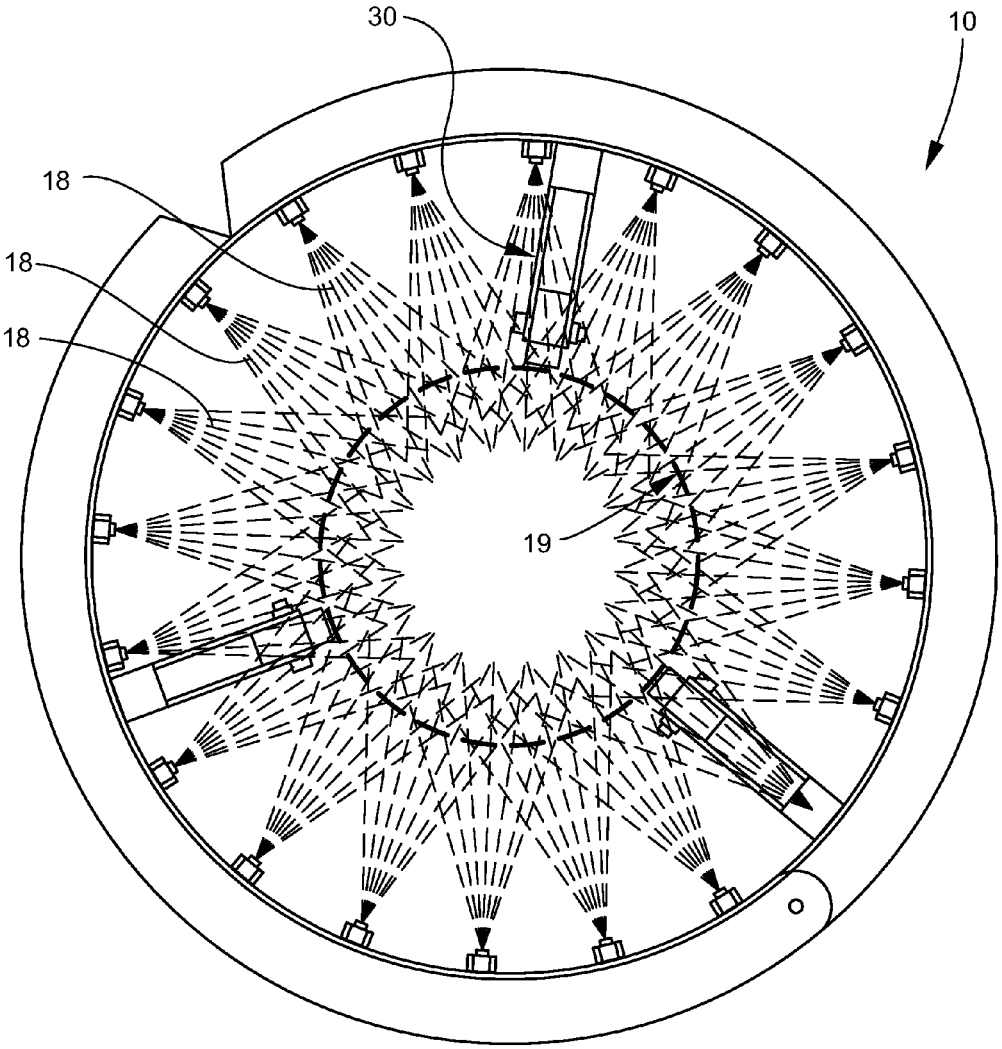
FIG. 5 is a bottom view of an exemplary spray frame showing overlapping spray patterns produced by an array of evenly spaced spray nozzles.

The nozzles are located, arranged and spaced around the spray frame in a precise and measured manner to provide a predictable and uniform spray pattern that is pre-calibrated for a given range/distance to the pole surface plane. The nozzles are also located so they can be accessed and re-calibrated or changed out quickly to facilitate changes in liquid chemical flow volume and pressure that may be necessary due to differences in pole surface areas and circumferences. In one embodiment the nozzles are evenly spaced in a circumferential line around the inside of the spray frame. The spacing between the nozzles is selected to produce overlapping spray patterns 18 shown in FIG. 5, such that every point around the pole preferably receives direct spray from multiple spray nozzles. In the particular embodiment shown, every point on the surface of the pole (indicated at dotted line 19) receives direct spray from at least five spray nozzles, each coming from a different direction.

The above described overlap of spray patterns can result in a certain degree of interference and degradation of the intersecting patterns. The inventors have discovered that such interference can be reduced, and the coating effectiveness improved by arranging the nozzles in a vertically offset pattern. For example the nozzles may be arranged such that each nozzle is vertically offset relative the adjacent nozzles on either side of it. In the embodiments depicted in FIGS. 1 through 4, the nozzles are vertically offset in an alternating pattern, defining upper and lower nozzle sets indicated at dotted lines 28 and 29 respectively (see FIG. 1). The upper and lower nozzle sets are each supplied by a dedicated manifold, such as manifolds 41 and 42, and each manifold is equipped with a shut-off valve 23. Thus one or both sets of nozzles may be operational at any given time as needed.

Anti-Drift Shield

Referring again to FIG. 3, an anti-drift shield 37 extends above or below the spray frame, acting to reduce wind induced drift of the chemical being sprayed on the pole. The anti-drift shield is comprised of a shroud or curtain of flexible material encompassing substantially the entire circumference perimeter of the spray frame, effectively increasing the vertical height of the spray frame. In one embodiment the anti-drift shield is made of a clear or translucent material so that a system operator can observe and monitor the spray from the nozzles 26 from a ground position, or from an elevated aerial platform such as aerial bucket 51. Alternatively the anti-drift shield may be made of a suitable rigid material that is partially or completely opaque, such as fiberglass or aluminum. The anti-drift shield 37 may comprise a separate detachable part, or alternatively the anti-drift shield and spray frame may comprise a substantially integrated, translucent component.

Pressurized Fluid Source

Figure 6:
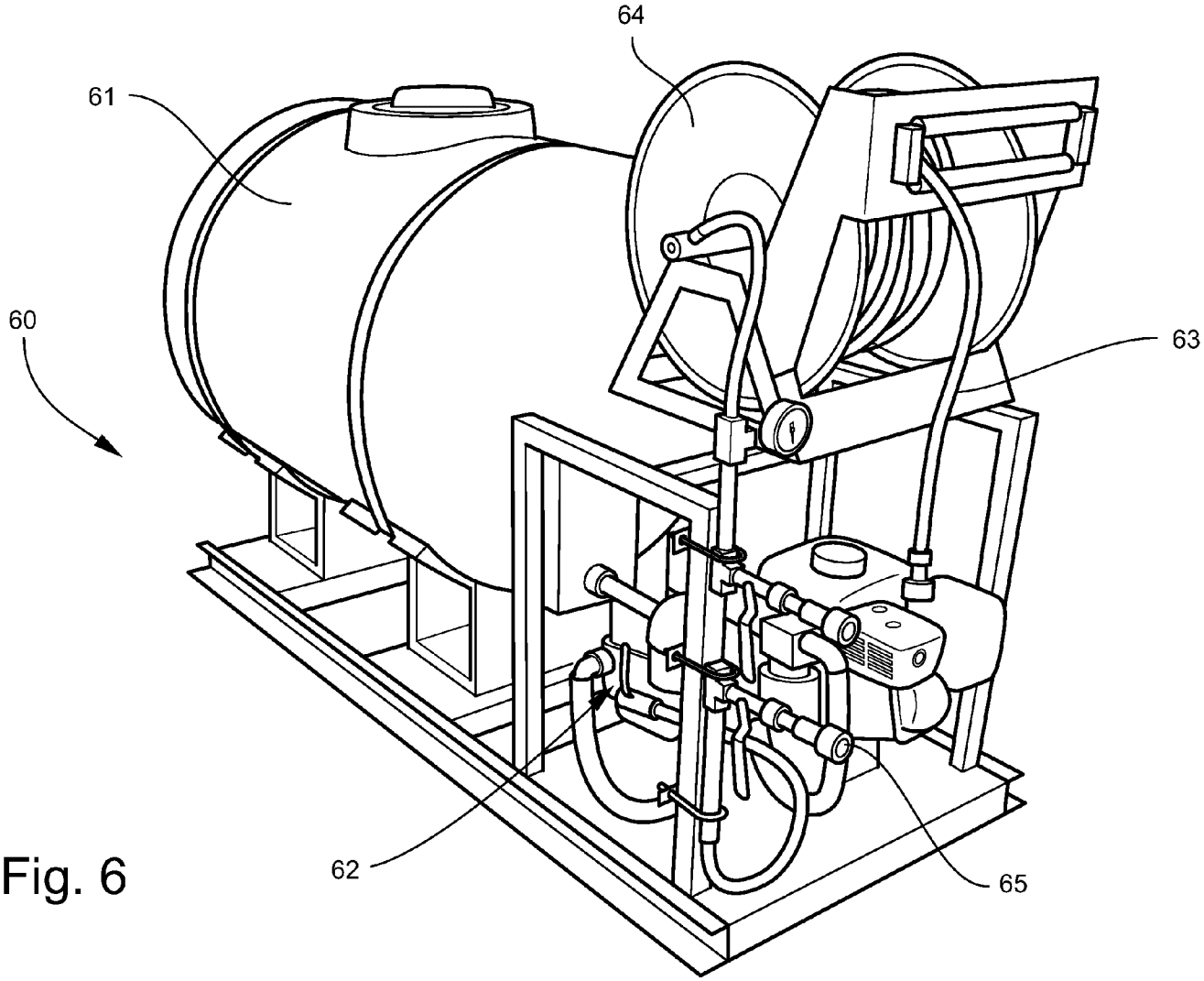
FIG. 6 shows a material storage and transfer cart equipped with liquid chemical storage tank, a variable pressure mechanical pump, and chemical supply hose.

Referring to FIG. 6, the pressurized liquid chemical source incorporates a material storage tank 61 that holds the chemical fluid, and a precision, variable-pressure mechanical pump 62 that moves the chemical fluid to the spray frame at a predetermined pressure and volume flow rate. In the depicted embodiment the variable-pressure pump 62 pumps the chemical fluid from storage tank 61 through a supply hose 63 stored on a hose reel 64, to the spray frame's supply hose connection 21. The storage tank, pump, and supply hose may be conveniently packaged together on a dedicated material storage and transfer cart, indicated generally at reference numeral 60 in FIG. 6. Cart 60 may further include additional hose connections 65 in fluid communication with pump 62 for connecting one or more optional hand held sprayers (not shown). Alternatively the liquid storage and transfer elements on cart 60 may be situated elsewhere, such as on a vehicle that also supports a mobility system electronic control system such as those described further below.

Suspension Mobility System

Figure 7:
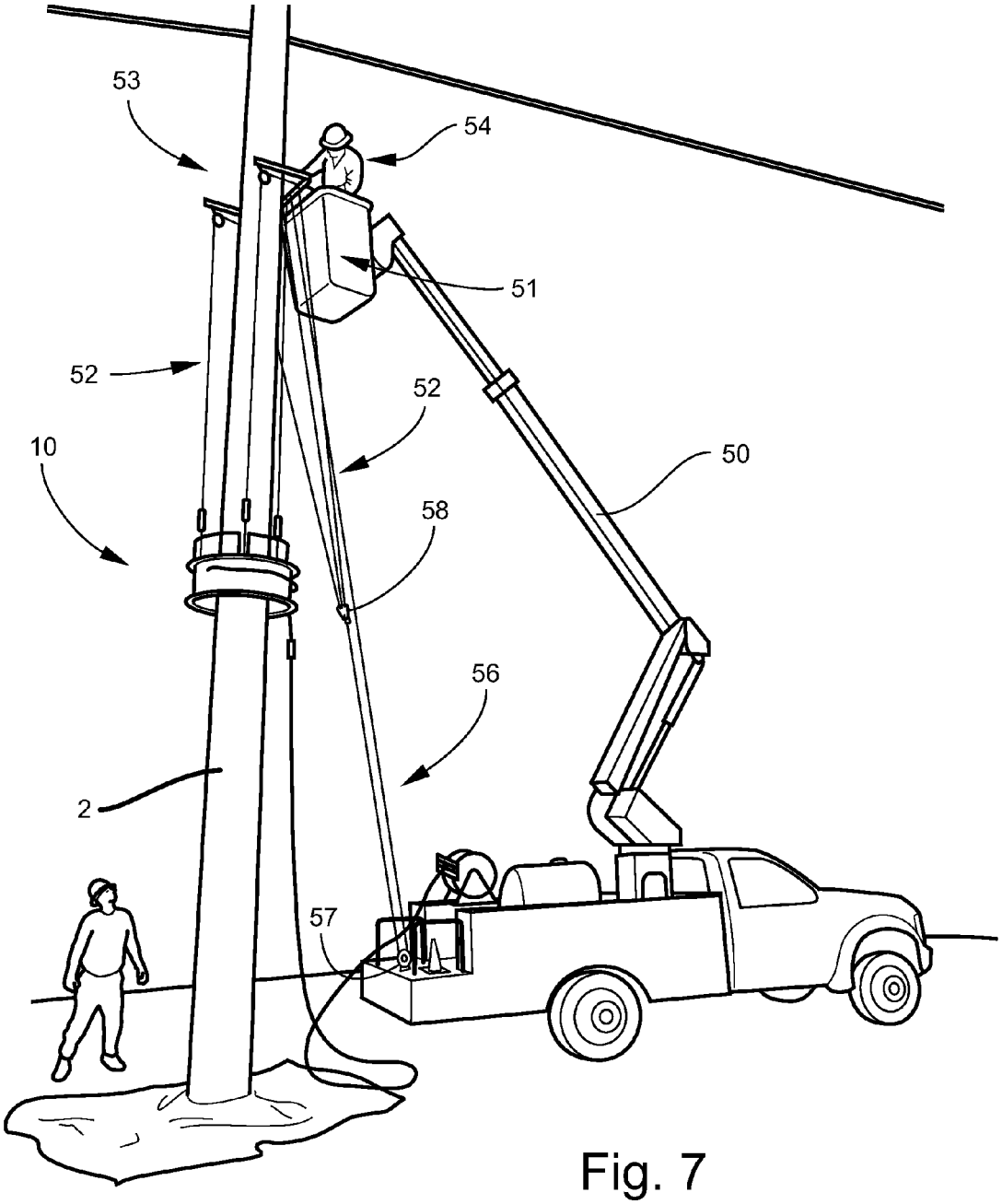
FIG. 7 illustrates a suspension type mobility system utilizing cords and a winch to support and translate a pole sprayer along a vertical pole.
Figure 8:
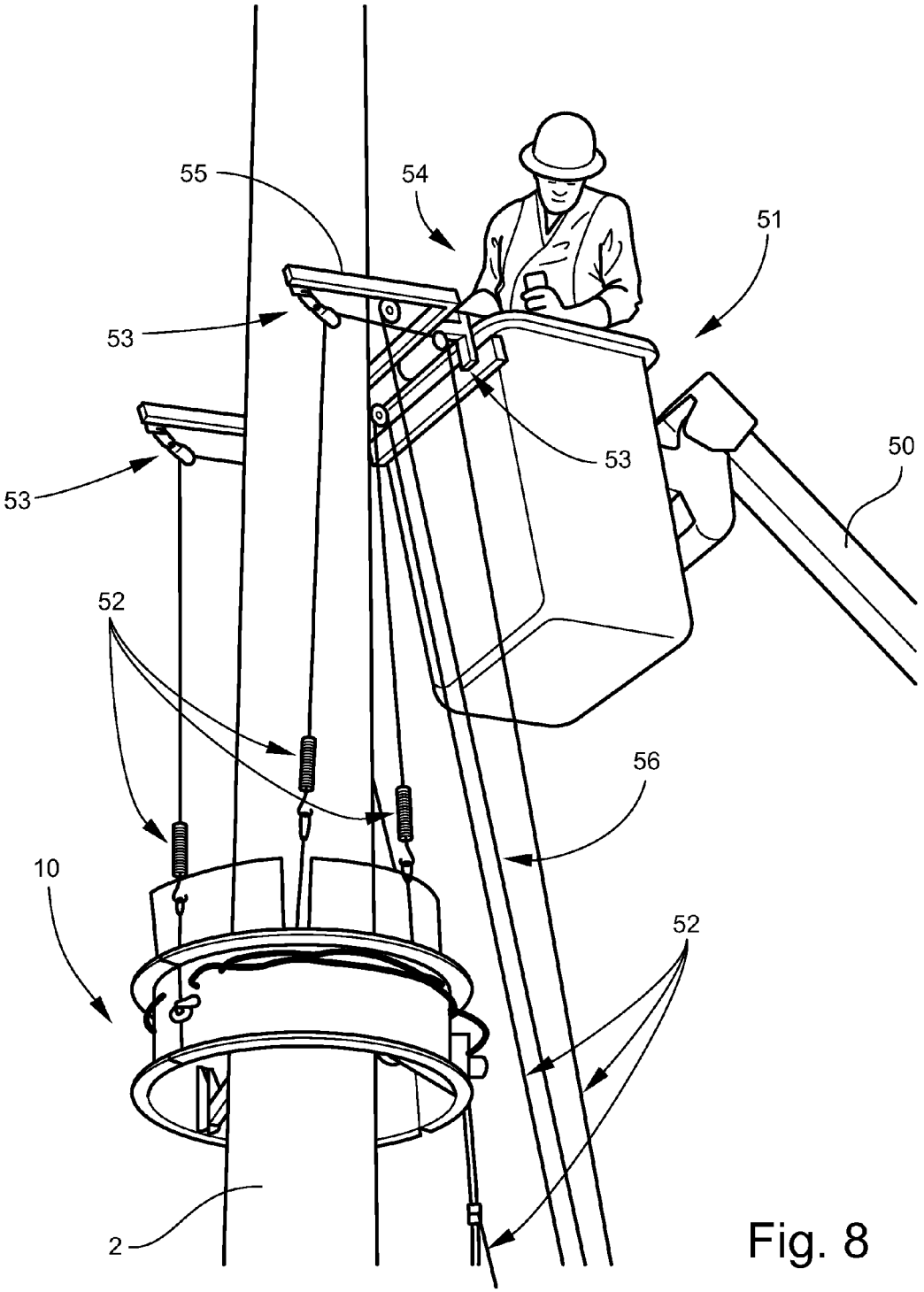
FIG. 8 is a close-up view of the mobility system of FIG. 7 showing the suspension frame and pulleys supported by an aerial bucket, and suspension cords going through the pulleys and supporting the spray frame.
Figure 9:
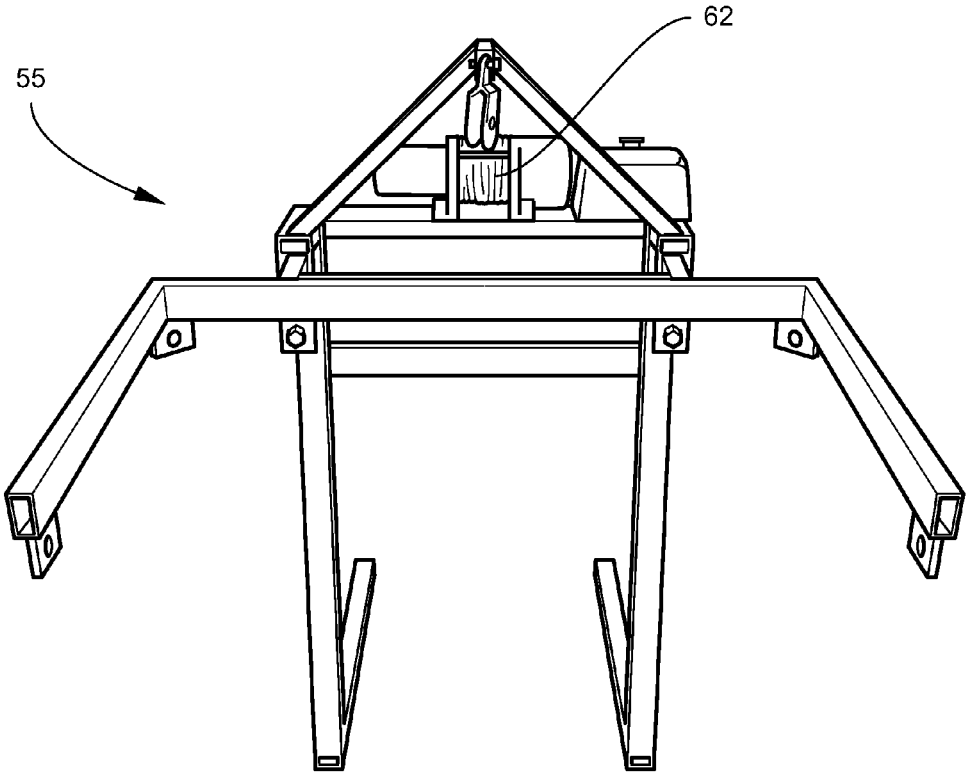
FIG. 9 is a suspension frame for use in conjunction with the suspension type mobility system of FIGS. 7 and 8.

The pole spraying system utilizes a mobility system for moving the sprayer up and down the axis of the vertical pole at a steady, precisely controlled rate of movement as the chemical is being applied. In one embodiment of the mobility system, the spray frame 10 is suspended from above using frame suspension brackets 15 (see FIG. 1) on the top rim of the spray frame. For example, referring to FIGS. 7 through 9, the spray frame may be suspended using a system of suspension cords (or cables) 52 that extend up from the spray frame, through suspension pulleys 53, and connect to a winch 54. In the depicted embodiment the suspension pulleys 53 and winch 54 are part of a suspension frame 55 mounted to an aerial bucket 51 and positioned about the pole, well above the portion of the pole being treated. The winch 54 may be manually or electrically powered, and may be located and operated from above the spray frame such as at bucket 51, or at a remote position such as on the ground or in a vehicle.

The system is configured where all of the suspension cords 52 connected to the spray frame are pulled in or let out simultaneously and uniformly when the winch is operated, resulting in the spray frame staying level as it moves up and down along the pole. In the depicted embodiment, a winch cable 56 extends down from the elevated winch 54, through a ground pulley 57, and back up to a connection plate 58 that connects the winch cable 56 to the suspension cords 52. When the winch cable is reeled in, connection plate 58 is pulled downward toward ground pulley 57, pulling all of the cords 52 downward with it. Thus all of the suspension cords are pulled through the suspension pulleys 53 by the same amount, causing each cord to lift the spray frame 10 by the same amount, maintaining the spray frame in a level orientation. The spray frame may be lowered by simply feeding the winch cable out and allowing gravity to bring the spray frame down in a level manner.

Centering Arms

Figure 10:
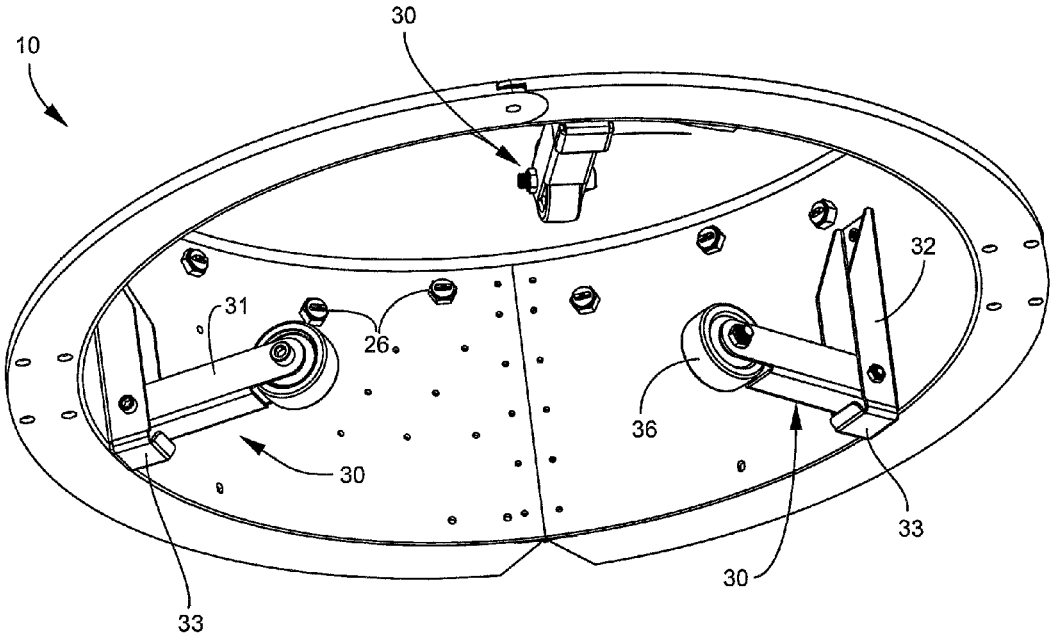
FIGS. 10 and 11 depict the compliant and dampening centering arms used in conjunction with a suspension type mobility system.
Figure 11:
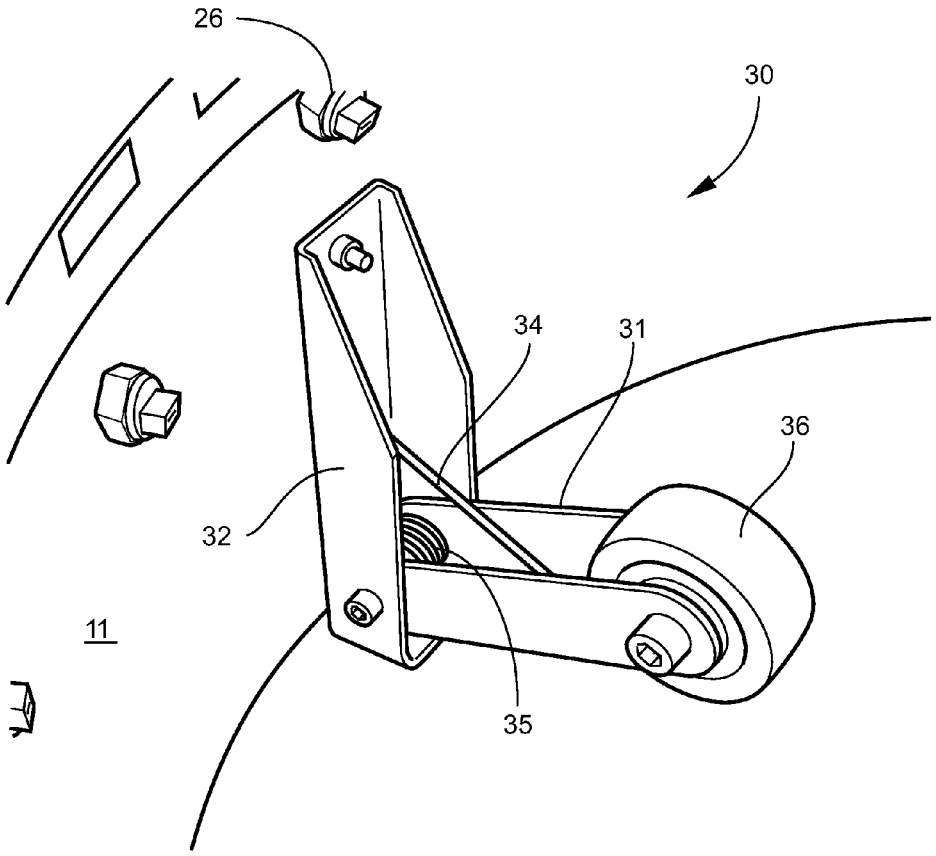
Figure 12:
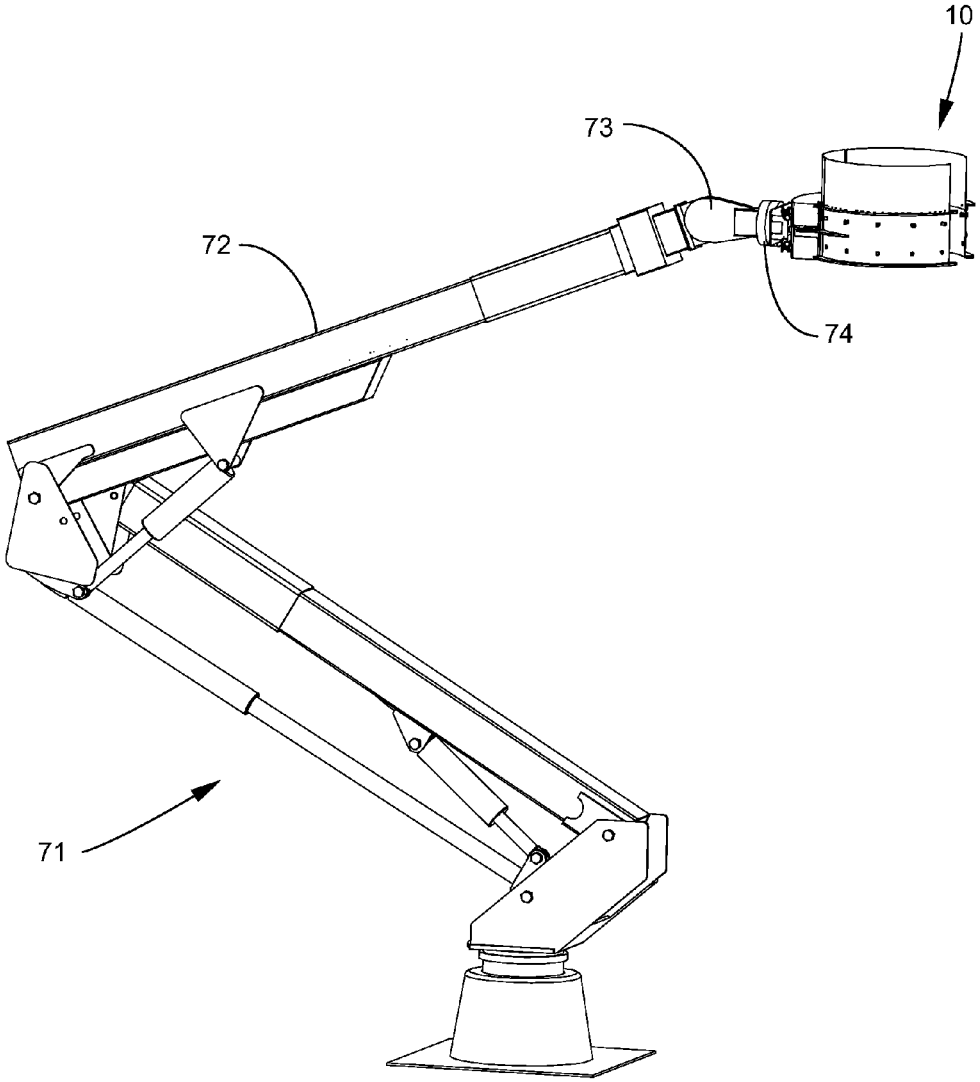
FIG. 12 is a spray frame mounted to a robotic mobility system in accordance with the present disclosure.

As the sprayer moves along the length of the pole, a relatively constant stand-off distance between the spray nozzles 26 and the pole surface is preferably maintained. In a suspension type mobility system of the type described above, this may be accomplished using a passive centering guide built into the spray frame. Referring to FIGS. 10 and 11, an exemplary centering guide consists of three or more spring loaded centering arms 30 that extend radially inward from the inside of the spray frame 10 toward the surface of the pole. Each centering arm 30 comprises an arm body 31 terminating in a roller 36. The rollers 36 serve to reduce any undue friction, and minimize the effect of collisions or interference with the pole surface. The arm body 31 is pivotally mounted in an arm body bracket 32, allowing the arm body to rotate about the pivot in a vertical plane. A torsion spring 35 at the pivot connection biases the arm body 31 to rotate downward, and an extension stop 33 limits the downward rotation to a predetermined maximum angle, such as ninety degrees to the surface of the frame body 11.

The arm body 31 may be restrained at any rotation angle less than ninety degrees however using the arm body extension adjuster 34. In the depicted embodiment the extension adjuster 34 is a flexible cord or cable extending from the arm body bracket 32 (or frame body 11) to the arm body 31, acting to limit downward rotation of arm body 31 to the point at which the cord is pulled taught. The angle of the arm body 31, and radial location of roller 36, may thus be adjusted by simply changing the length of the extension adjuster, such as by passing the cord out through a hole in the frame body 11 and tying it off (see FIG. 4). In operation, the extension adjusters may be set to a length that positions the arms such that the rollers 36 are in close proximity to, or just contacting the surface of the pole. The torsion spring 35 may be selected or adjusted to give the centering arms a suitable amount of compliance in this position. Properly configured springs 35 will allow the centering arms to deflect if needed to accommodate bumps or shape variations in the pole, while providing enough force to keep the pole centered and dampen lateral movement of the spray frame.

Robot Mobility

In another embodiment, the pole spraying system utilizes a fully robotic mobility system. Referring to FIGS. 12 through 16, the spray frame 10 may be attached to a multi-axis robot, such as the electro-hydraulic, fully articulated, robotic aerial boom 71 shown in FIG. 12, to provide precise mechanical movement and positioning of the sprayer frame up and down the vertical pole axis. In one such embodiment the aerial boom 71 has a vertical reach of 60 feet, a tilt range at distal end pivot joint 73 of at least 180 degrees, and a rotation range at wrist joint 74 of at least 360 degrees. Distal end pivot joint 73 and wrist joint 74 may thus be utilized to maintain the spray frame in a level orientation as it is translated along the pole in a spraying operation. The robotic aerial boom 71 may be operated using a suitable electronic control system that ideally allows for either manual control, or pre-programmed automatic control of movement and sprayer functions.

Figure 13:
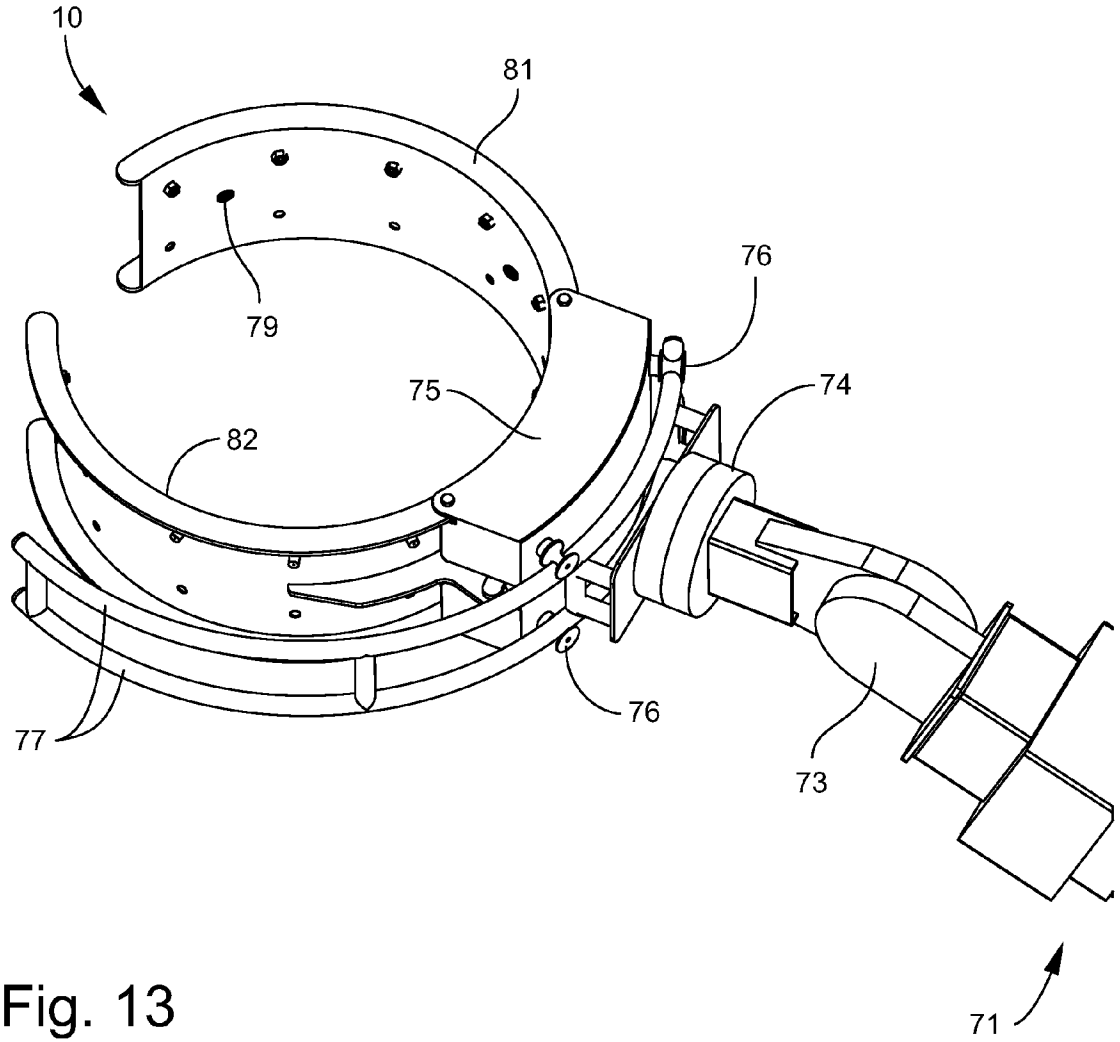
FIG. 13 is a close up perspective view of the spray frame of FIG. 12 showing the guide rail and roller system for rotating the spray frame about its central longitudinal axis.
Figure 14:
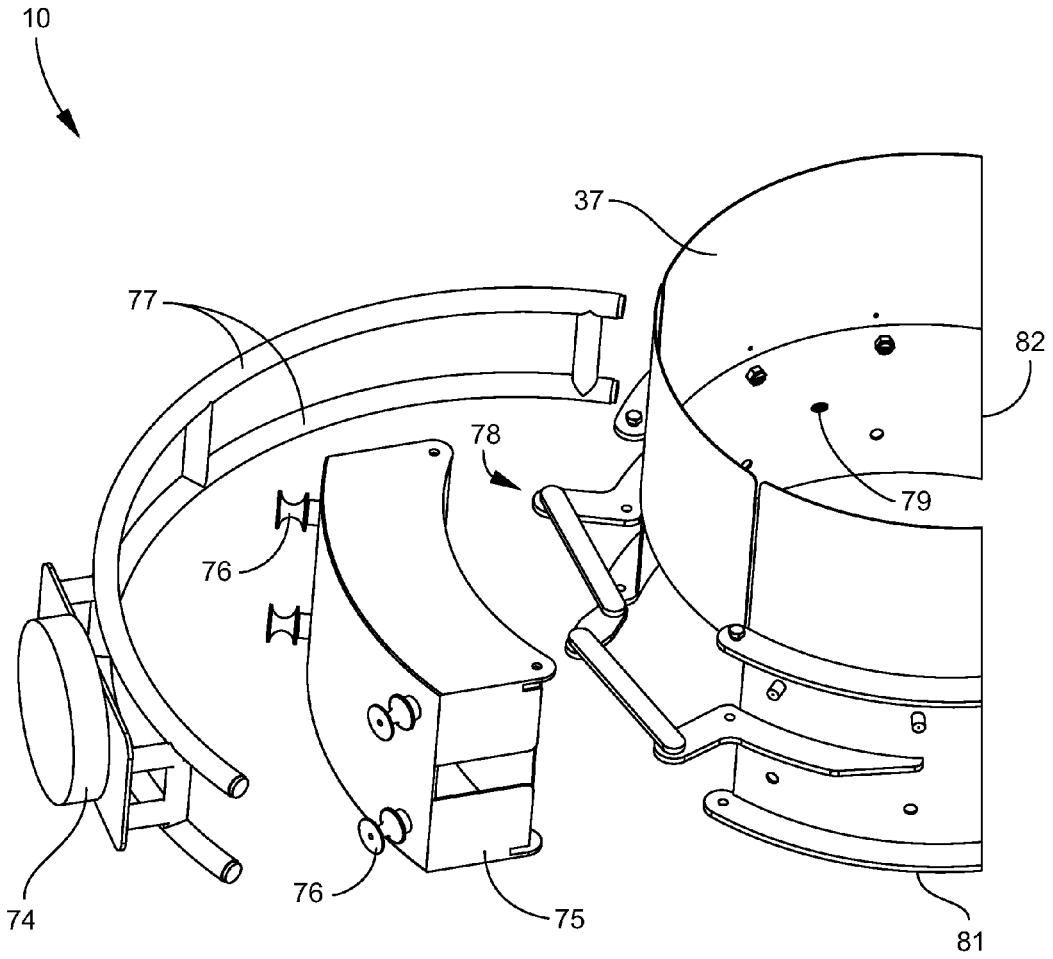
FIG. 14 is an exploded view of the spray frame of FIG. 13.
Figure 15A:
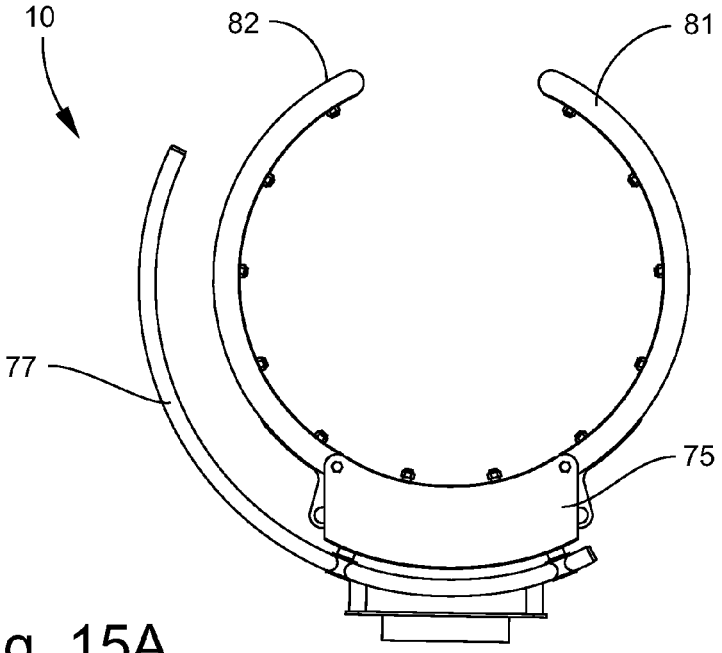
FIGS. 15A and 15B are top views of the spray frame of FIG. 13 shown in closed and open positions respectively.
Figure 15B:
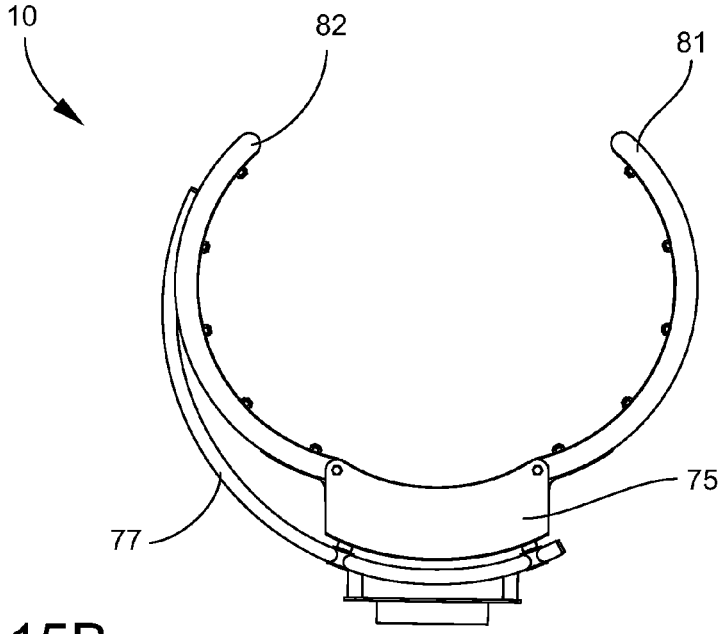

Referring to FIG. 13, in this embodiment the spray frame 10 is again in two semicircular halves 81, 82, however instead of being hinged directly together, the two halves are pivotally mounted to a spray frame head 75 that is supported by rollers 76 on arcuate guide rails 77 mounted to wrist joint 74. Referring to the exploded view of FIG. 14, the spray frame halves are connected inside frame head 75 by a linkage 78 operable to simultaneously pivot the two frame halves to either open or close the spray frame. Linkage 78 may be driven by a suitable actuator or servo mechanism built into frame head 75. For example, by operating linkage 78 the spray frame halves may be positioned in a closed, circular configuration as shown in FIG. 15A, or spread apart as shown in FIG. 15B for moving the spray frame into position around a pole. As can be seen, the guide rails 77 effectively limit the maximum amount that the frame halves can be spread apart.

Figure 16A:
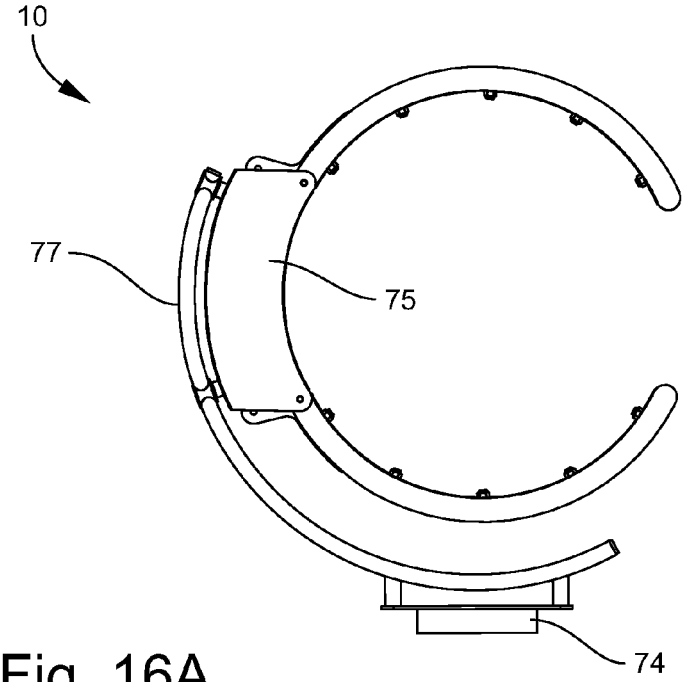
FIGS. 16A and 16B are top and bottom views of the spray frame of FIG. 13 shown with the spray frame rotated ninety degrees from center.
Figure 16B:
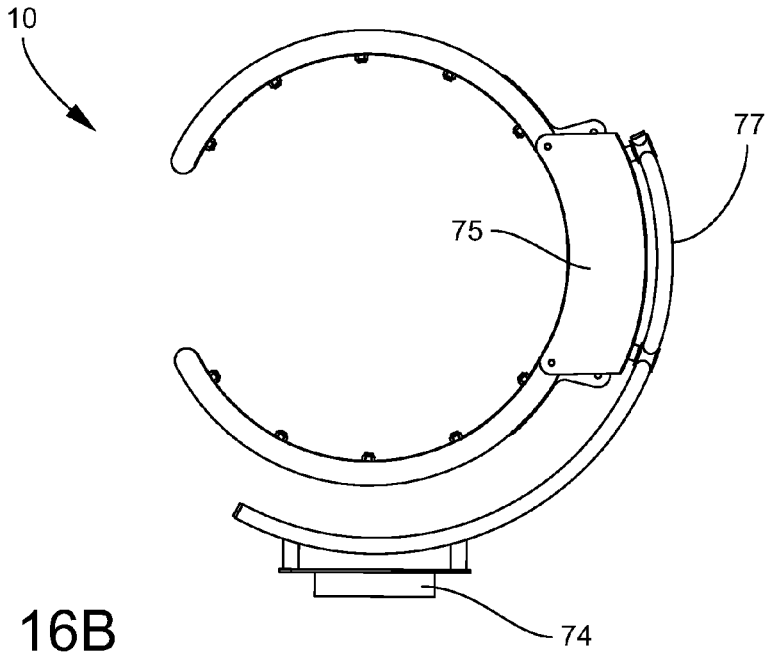

The frame head 75 is movable along the guide rails 77 to create rotation of the spray frame about a central axis of the spray frame cylinder, or correspondingly, rotation of the spray frame about an encircled vertical pole. In the depicted embodiment the guide rails 77 extend in one direction from the frame head 75, providing for approximately 90 degrees of spray frame rotation between the centered position shown in FIG. 13 with the opening between the free ends of halves 81, 82 extending straight away from the aerial boom, and a maximum rotation position shown in FIG. 16A with the opening facing to one side. Alternatively guide rails 77 may extend around both sides of the spray frame, allowing for 180 degrees of rotation. In the depicted one-sided configuration, another 90 degrees of rotation in the opposite direction can be obtained using wrist joint 74 to simply invert the spray frame as shown in FIG. 16B. Spray frame head 75 may incorporate an electric motor (not shown) configured to operatively engage a belt or gear system on guide rails 77 to produce the controlled rotational motion.

The spray frame may further include a centering guide in the form of non-contact proximity sensors 79 (see FIGS. 13 and 14) disposed about the inside of the frame body 11. The proximity sensors may be configured to accurately detect the stand-off distance between the spray frame and pole, and transmit that information as a data signal to the aerial boom electronic control system. Suitable laser proximity sensors are commercially available and in common use for many applications such as for example vehicle backup proximity alarms.

In a spraying operation, the control system may be initially used in a manual mode to first open the spray frame halves 81, 82 with linkages 78, move the spray frame laterally into position around the pole by operating the aerial boom 71, and close the spray frame. The control system may then be operated in a pre-programmed, or automatic mode to cause the aerial boom 71 to move the spray frame up or down along the length of the pole, while keeping the frame level and the pole centered using data signals from proximity sensors 79. The control system may further include capability for sensing and controlling certain functions of the pressurized liquid chemical source, such as for example, modulating a flow valve or pressure regulator based on measured values, to control the flow rate and pressure of fluid being transferred to the spray frame.

Method of Use

Figure 17:
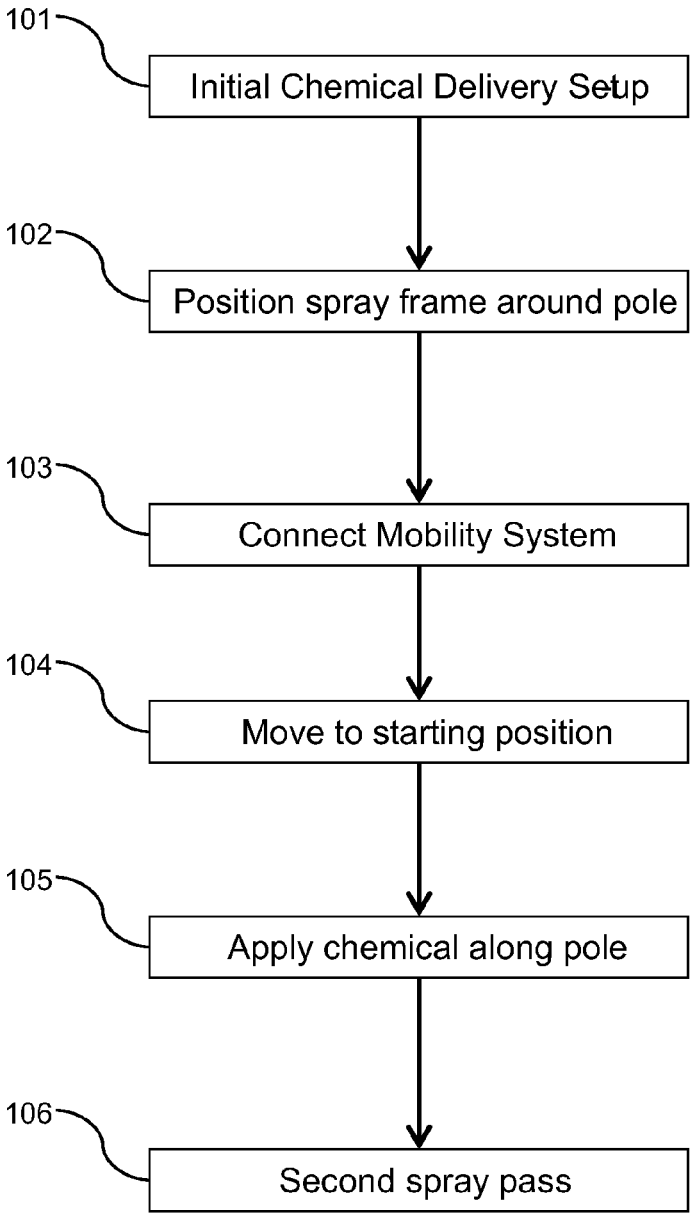
FIG. 17 is a flow chart depicting a method of using the pole spraying system to coat a vertical pole.

An exemplary process of using the pole sprayer to apply chemical to a pole is illustrated in the functional block diagram of FIG. 17. Referring to functional block 101, an initial chemical delivery set-up is established for producing a desired chemical pressure and flow rate at the spray nozzles. The determination of the chemical delivery set-up may take into account various relevant factors such as the porosity of the pole surface, the type of chemical being applied, viscosity of the chemical, the ambient temperature, local wind speed, and the movement rate of the spray frame, among others. Based on such factors, an initial chemical pressure and flow rate at the nozzles is determined. The chemical delivery set-up comprises settings and parameters that affect the chemical pressure and flow rate, such as the nozzle orifice size, the pump pressure, and the pump volume flow rate. An initial set-up may be done manually, adjusting physical controls such as valves and pressure regulators by hand; or electronically such as through a graphical user interface of a computer based control system. Such a computer based control system may be used for providing other functions, including for example the previously mentioned electronic control capability for operating the fully articulated aerial boom 71.

Referring to block 102, the spray frame is installed around the pole. In an embodiment such as that of FIG. 1, the spray frame may be manually carried into position using the frame grip handles 14, and closed using hand crank 91, or latched together around the pole using frame latch 16. Alternatively, when used in connection with the robotic mobility system, the aerial boom and electronic controls may be used to move the spray frame into position and close it around the pole. The anti-drift shields, if used, may be pre-attached, or installed after the spray frame is positioned around the pole.

Referring now to block 103, the mobility system is connected to the spray frame. In the suspension type mobility system of FIG. 7, this may involve setting up the winch, the suspension frame, the pulleys, and attaching cords 52 to the spray frame. For the robotic mobility system, the spray frame is necessarily already connected to the aerial boom prior to the step of positioning the spray frame around the pole.

Referring to block 104, the spray frame is moved to a starting position on the pole using the mobility system. During a spraying process the spray frame may move either up or down the pole at a steady rate. Thus, the starting position may be near or at the bottom of the pole if the spray frame moves upward while spraying, or at an elevated position on the pole for a downward moving spray process.

Referring to block 105, the chemical spray is initiated, and the mobility system is operated to translate the spray frame from the starting position along the pole at a predetermined, precisely controlled rate, while the pole is evenly and thoroughly coated with liquid chemical. When the spray frame reaches the end of the section of pole being treated, the vertical movement is stopped, and the chemical delivery is turned off. Starting, stopping, and controlling the rate of movement may be accomplished manually such as by operating a winch and turning off a valve, or electronically and automatically using the computer based electronic control system.

Referring to block 106, the chemical may be applied in a single pass along the pole, such as by starting at the bottom of the pole at ground level and moving the spray frame up the pole to an upper end of the coated region. Alternatively the pole may be coated in multiple passes, such as by making a first pass moving up the pole, then reversing direction at the top and spraying the pole from the top down. Coating uniformity may also be enhanced by changing the orientation of the spray frame between passes, for example by making a first pass with the frame at a first location on guide rails 77, then axially rotating the spray frame to a second location on guide rails 77 and making a second pass. In one embodiment the second location is between 90 and 180 degrees from the first location.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A system for applying a fluid chemical treatment to a vertical column, comprising:

a spray frame configured as a cylindrical shell with upper and lower ends, the spray frame configured to concentrically surround a length of the column with a substantial annular gap between an inner cylindrical surface of the spray frame and an outer surface of the column;

a centering guide disposed on the inner surface of the spray frame configured to maintain uniformity of the annular gap;

an array of fluid spray nozzles disposed about the inner cylindrical surface of the spray frame, and connected to a pressurized fluid chemical source, the array of fluid nozzles arranged to apply a uniform spray coating of the fluid chemical treatment to a portion of the column surrounded by the spray frame; and a mobility system connected to the spray frame and configured to translate the spray frame along the column in a level orientation while applying the fluid chemical treatment, the mobility system comprising a winching apparatus attached to the end of a truck mounted fully articulated aerial boom, the winching apparatus including suspension frame members configured to be positioned about the column by the aerial boom in a horizontal level orientation at a position above the spray frame, and at least three suspension cords attached to the upper end of the spray frame at evenly spaced suspension points and extending upward from the spray frame to the suspension frame members of the winching apparatus, wherein the winching apparatus is configured to raise and lower the spray frame by simultaneously pulling in or letting out each suspension cord at an equal rate.

2. The system of claim 1, wherein the spray frame comprises two semicircular, rigid shells, each shell hinged on one edge in a clamshell arrangement.

3. The system of claim 2, further comprising a manifold connecting the array of fluid spray nozzles to the pressurized fluid chemical source.

4. The system of claim 3, wherein the pressurized fluid chemical source comprises a fluid storage tank, a variable-pressure mechanical fluid pump, and a fluid supply hose.

5. The system of claim 1, wherein each of the suspension cords passes through a pulley attached to the suspension frame, and substantially downward from there to a connection point at which all of the suspension cords are connected to a single cable extending from a winch.

6. The system of claim 1, wherein the centering guide comprises at least three centering arms, each with a first end pivotally mounted to the inner cylindrical surface of the spray frame, and a second end with a roller, and wherein each of the at least three centering arms is configured to pivotally rotate up and down in a vertical plane such that downward rotation brings the roller closer to the column.

7. The system of claim 6, wherein each of the at least three centering arms further comprises a torsion spring configured to bias the centering arm to rotate downward, and an arm extension adjuster that stops the spring biased rotation of the centering arm at a predetermined, adjustable angle.

8. A system for applying a fluid chemical treatment to a wood utility pole, comprising:

a spray frame configured to substantially concentrically surround the pole with a gap between an inner surface of the spray frame and an outer surface of the pole;

a centering guide on the inner surface of the spray frame configured to maintain concentricity of the spray frame to the pole;

an array of fluid spray nozzles in the spray frame connected to a pressurized fluid chemical source, and arranged to apply a uniform spray coating of the fluid chemical treatment to the pole; and a mobility system connected to the spray frame and configured to translate the spray frame along the pole in a level orientation while fluid chemical treatment is applied, the mobility system comprising a winching apparatus attached to the end of a truck mounted fully articulated aerial boom, the winching apparatus including suspension frame members configured to be positioned by the fully articulated aerial boom about the pole at a position above the spray frame in a horizontal level orientation, and at least three suspension cords attached to the upper end of the spray frame at evenly spaced suspension points and extending upward from the spray frame to the suspension frame members of the winching apparatus, wherein the winching apparatus is configured to raise and lower the spray frame by simultaneously pulling in or letting out each suspension cord at an equal rate.

9. The system of claim 8, wherein the array of fluid spray nozzles comprises a first set of nozzles fed by a first manifold, and a second set of nozzles fed by a second manifold, the first and second manifolds both connected to the pressurized fluid chemical source.

10. The system of claim 9, wherein the first and second sets of nozzles are vertically offset such that spray from the first set of nozzles is aimed at a higher point on the pole than spray from the second set of nozzles.

11. The system of claim 8, wherein the fluid spray nozzles are evenly spaced in a circumferential line around the inner surface of the spray frame, and the spacing between the fluid spray nozzles is selected to produce overlapping spray patterns such that every point around the pole in line with the fluid spray nozzles receives direct spray from at least two fluid spray nozzles.

12. The system of claim 8, wherein the spray frame comprises two semicircular frame halves hinged at one end in a clamshell configuration, and moveable between an open position in which a space between free ends of the frame halves is greater than a width of the pole, and a closed position in which the space between the free ends of the frame halves is less than the width of the pole, the frame halves in the closed position together defining a substantially cylindrical shape.

13. A system for applying a fluid chemical treatment to a vertical column, comprising:

a spray frame configured as a curved shell with upper and lower ends, the spray frame configured to substantially surround a length of the column with a substantially uniform gap between an inner surface of the spray frame and an outer surface of the column;

an array of fluid spray nozzles disposed about the inner surface of the spray frame, and connected to a pressurized fluid chemical source, the fluid spray nozzles arranged to apply a uniform spray coating of the fluid chemical treatment to a portion of the column surrounded by the spray frame; and a mobility system configured to vertically translate the spray frame along the column while applying the fluid chemical treatment, in which the spray frame is attached to a truck mounted fully articulated electro-hydraulic aerial boom operable to position the spray frame about the column and move the spray frame vertically along the column while keeping the spray frame in a horizontal level orientation and maintaining uniformity of the gap between the spray frame and an outer surface of the column.

14. The system of claim 13, further comprising a series of proximity sensors on the spray frame configured to detect the distance between the inner surface of the spray frame and the outer surface of the column, and to transmit that information as a data signal to an electronic control system.

15. The system of claim 14, wherein the control system is operable to cause the aerial boom to maintain uniformity of the gap between the spray frame and the column using the data signal from the proximity sensors.

16. The system of claim 13, wherein the spray frame comprises two semicircular, rigid shells, each shell hinged on one edge in a clamshell arrangement.

17. The system of claim 16, further comprising an actuator and linkage connected to the spray frame, and configured to cause the semicircular rigid shells to pivot about the hinged edges.

* * * * *